US007053847B2

(12) United States Patent
Chan et al.

(10) Patent No.: US 7,053,847 B2
(45) Date of Patent: May 30, 2006

(54) MILLIMETER WAVE PHASED ARRAY SYSTEMS WITH RING SLOT RADIATOR ELEMENT

(75) Inventors: Steven S. Chan, Alhambra, CA (US); Te Kao Wu, Rancho Palos Verdes, CA (US); Arun Bhattacharyya, El Segundo, CA (US); Juan Rivera, Torrance, CA (US); Phillip L. Metzen, Hermosa Beach, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 125 days.

(21) Appl. No.: 10/917,986

(22) Filed: Aug. 11, 2004

(65) Prior Publication Data

US 2006/0033671 A1 Feb. 16, 2006

(51) Int. Cl.
*H01Q 13/12* (2006.01)
*H01Q 13/10* (2006.01)

(52) U.S. Cl. ..... 343/769; 343/770

(58) Field of Classification Search ..... 343/767, 343/769, 770
See application file for complete search history.

(56) References Cited

U.S. PATENT DOCUMENTS 5,539,415 A * 7/1996 Metzen et al. ..... 343/700 MS
5,539,420 A * 7/1996 Dusseux et al. ..... 343/769
5,703,601 A * 12/1997 Nalbandian et al. . 343/700 MS
5,818,391 A * 10/1998 Lee ..... 343/700 MS
6,160,522 A * 12/2000 Sanford ..... 343/769
6,166,692 A * 12/2000 Nalbandian et al. . 343/700 MS
6,184,828 B1 * 2/2001 Shoki ..... 342/372
6,219,002 B1 * 4/2001 Lim ..... 343/769
6,492,949 B1 * 12/2002 Breglia et al. ..... 343/700 MS

OTHER PUBLICATIONS

Phillip L. Metzen et al., "The Globalstar cellular satellite system," IEEE Trans. vol. AP-46, No. 6, Jun. 1998, pp. 935-942.

* cited by examiner

*Primary Examiner*—Don Wong
*Assistant Examiner*—Leith Al-Nazer
(74) *Attorney, Agent, or Firm*—Patti & Brill, LLC

(57) ABSTRACT

A phased array antenna structure capable of operation at millimeter-wave frequencies and having multiple ring slot radiator elements (10). The RF feed structure for each radiator element includes a feed via (28) extending part-way through a multi-layer structure (FIG. 3) on which the radiator elements (10) are formed and a strip line feed probe (30) extending from the via (28) toward the radiator element. A key feature facilitating high-frequency operation is the inclusion of multiple mode suppressors (32) surrounding the via (28) and providing a smooth transition from a coaxial mode of RF transmission to a strip line mode of RF transmission. The feed probe (30) is tailored to provide either a narrow-band or a wideband frequency characteristic.

8 Claims, 8 Drawing Sheets

MILLIMETER WAVE PHASED ARRAY SYSTEMS WITH RING SLOT RADIATOR ELEMENT

BACKGROUND OF THE INVENTION

This invention relates generally to phased array antennas and, more particularly, to phased array systems using ring slot radiator elements. Phased array antenna systems provide a convenient technique for steering antenna beams electrically. Each phased array system consists of a relatively large number of antenna elements that are separately fed with a radio-frequency (RF) signal to be transmitted. By controlling the relative phase of the RF signal in the separate antenna elements of the array, one can effectively steer a beam emanating from the array. If the array is two-dimensional, the beam may be steered about two axes. It will be understood, of course, that although such antennas are often described in terms pertaining to a transmitting antenna, the same principles also apply to steering a receiving antenna.

Although such antenna systems are well known, in radar and communications systems they have typically employed conventional radiator elements, such as horn antennas, helical antennas, or open-ended waveguide elements. These conventional radiator elements are prohibitively large in size and weight, and are relatively costly to manufacture, especially for operation at millimeter wave frequencies (30–300 GHz). There is a requirement in some applications for phased array antenna systems that have very closely spaced radiator elements, to provide fast scanning of pencil beams over a large search or coverage volume without forming a grating lobe. A grating lobe is an unwanted lobe in the antenna radiation pattern, caused by steering the beam too far in relation to the element spacing.

Use of ring slot radiator elements in phased array systems has been proposed for low frequency applications. For example, U.S. Pat. No. 5,539,415, issued in the name of Phillip L. Metzen et al., discloses an antenna system with an array of ring slot radiators. The same system is disclosed in a paper by Phillip L. Metzen et al., entitled "The Globalstar cellular satellite system," IEEE Trans. Vol AP-46, no. 6, June 1998, pp. 935–942. The antenna array and associated feed probe structure disclosed in these publications is designed for operation in the L-band (1.61 GHz to 1.6265 GHz) and provides a very narrow (1%) bandwidth. Unfortunately, antenna systems of the type disclosed by Metzen et al. do not work at millimeter-wave frequencies, such as 35 GHz or higher. Moreover, the narrow 1% bandwidth is so narrow as to render the design very sensitive to manufacture, resulting in high production costs.

More specifically, one important reason that prior designs worked well at lower frequencies but not at millimeter-wave frequencies has to do with the difficulty of impedance matching a coaxial feed to a strip line mode for coupling to a ring slot radiator. At low frequencies, the thickness of a substrate on which the antenna array is formed is electrically quite thin (less than 2% of the operating wavelength). The feed probe, therefore, exhibits a negligibly small self-reactance, and transition from coaxial mode to the strip line mode requires little or no impedance matching. At millimeter-wave frequencies, a substrate of the same physical thickness has a significantly increased electrical thickness (about 12% of the operating wavelength). The self-reactance of the feed probe is, therefore, much larger, causing a serious impedance mismatch problem in the transition from coaxial mode to strip line mode.

Therefore, there is still a need for an antenna system using an array of ring slot radiators that can be operated at millimeter-wave frequencies, and preferably at a greater bandwidth. The present invention satisfies this need.

SUMMARY OF THE INVENTION

The present invention resides in a phased array antenna system operable at millimeter-wave frequencies, and in a ring slot radiator structure for use in a phased array antenna system. Briefly, and in general terms, the ring slot radiator structure of the invention comprises a dielectric substrate, having a top face and a bottom face; a conductive layer formed over the top face of the substrate and having an annular gap that in part defines a radiator element; a conductive feed via extending part-way through the substrate in a direction normal to the conductive layer, to transmit radio-frequency (RF) energy from a location located below the substrate to transition point located outside the annular gap in the conductive layer and spaced beneath the conductive layer; a strip line feed probe extending from the transition point in a generally radial direction parallel to the conductive layer and at least partially across the annual gap; and a plurality of mode suppressor posts extending through the substrate in a direction parallel to the conductive feed via and spaced in a generally uniform array around the conductive feed via. The plurality of mode suppressor posts effect a smooth transition from a coaxial mode of transmission through the conductive feed via to a strip line mode of transmission along the strip line feed probe that couples RF energy to the ring slot radiator.

The ring slot radiator structure may further comprise a plurality of mode suppressors, also extending in a direction normal to the conductive surface, and spaced uniformly around the annular gap to effect better isolation of the ring slot radiator element from other neighboring radiator elements.

In one disclosed embodiment of the invention, the strip line feed probe is generally uniform in width and extends fully across the annular gap toward the geometric center of the annular gap. In this configuration, the ring slot radiator structure has a relatively narrow bandwidth in the order of 1%.

In another disclosed embodiment of the invention, the strip line feed probe comprises a first section of uniform width extending from the transition point to a point near the outer diameter of the annular gap, and a contiguous transition section of increased width extending part-way across the annular gap. In this configuration, the ring slot radiator structure has an increased bandwidth in the order of 10%.

The invention may also be defined as a miniature phased array antenna system capable of operation at millimeter-wave frequencies and formed as a unitary structure. The antenna system comprises a multilayer structure having an upper face from which radiation is transmitted in a transmit mode of operation and which receives radiation in a receive mode of operation, and a lower face to accommodate radio-frequency (RF) feed and control circuitry; a conductive layer formed over the top face of the substrate and having a plurality of annular gaps formed in a geometric array, wherein each annular gap in part defines one of a plurality of ring slot radiator elements; an equal plurality of conductive feed vias extending part-way through the multilayer structure in a direction normal to the conductive layer, each capable of transmitting radio-frequency (RF) energy from a location located at the bottom of the substrate to transition point located outside one of the annular gaps in the conductive layer and spaced beneath the conductive layer; an equal plurality of strip line feed probes, each extending from the transition point associate with one of the plurality of radiator elements in a generally radial direction with respect to its annular gap, parallel to the conductive layer and at least partially across the annual gap; an RF divider/combiner, integrated into the multi-layer structure and coupled to each of the conductive feed vias and to an RF transmitter/receiver connector; and an equal plurality of sets of mode suppressor posts, each set being associated with a corresponding one of the conductive feed vias, and extending through the multi-layer structure in a direction parallel to the conductive feed via and spaced in a generally uniform array around the conductive feed via. Each set of mode suppressor posts effects a smooth transition from a coaxial mode of transmission through the conductive feed via to a strip line mode of transmission along the strip line feed probe that couples RF energy to the ring slot radiator.

It will be appreciated from the foregoing that the present invention represents a significant advance in the field of miniature phase array antennas capable of operation at millimeter-wave frequencies. In particular, the invention provides a ring slot radiator structure that facilitates smooth RF coupling from a coaxial mode of transmission to a strip line mode for transmission and coupling to each ring slot radiator. The invention also provides alternate configurations for narrow-band and wideband operation. Other aspects and advantages of the invention will become apparent from the following more detailed description, taken in conjunction with the accompanying drawings.

DETAILED DESCRIPTION OF THE INVENTION

Figure 1:
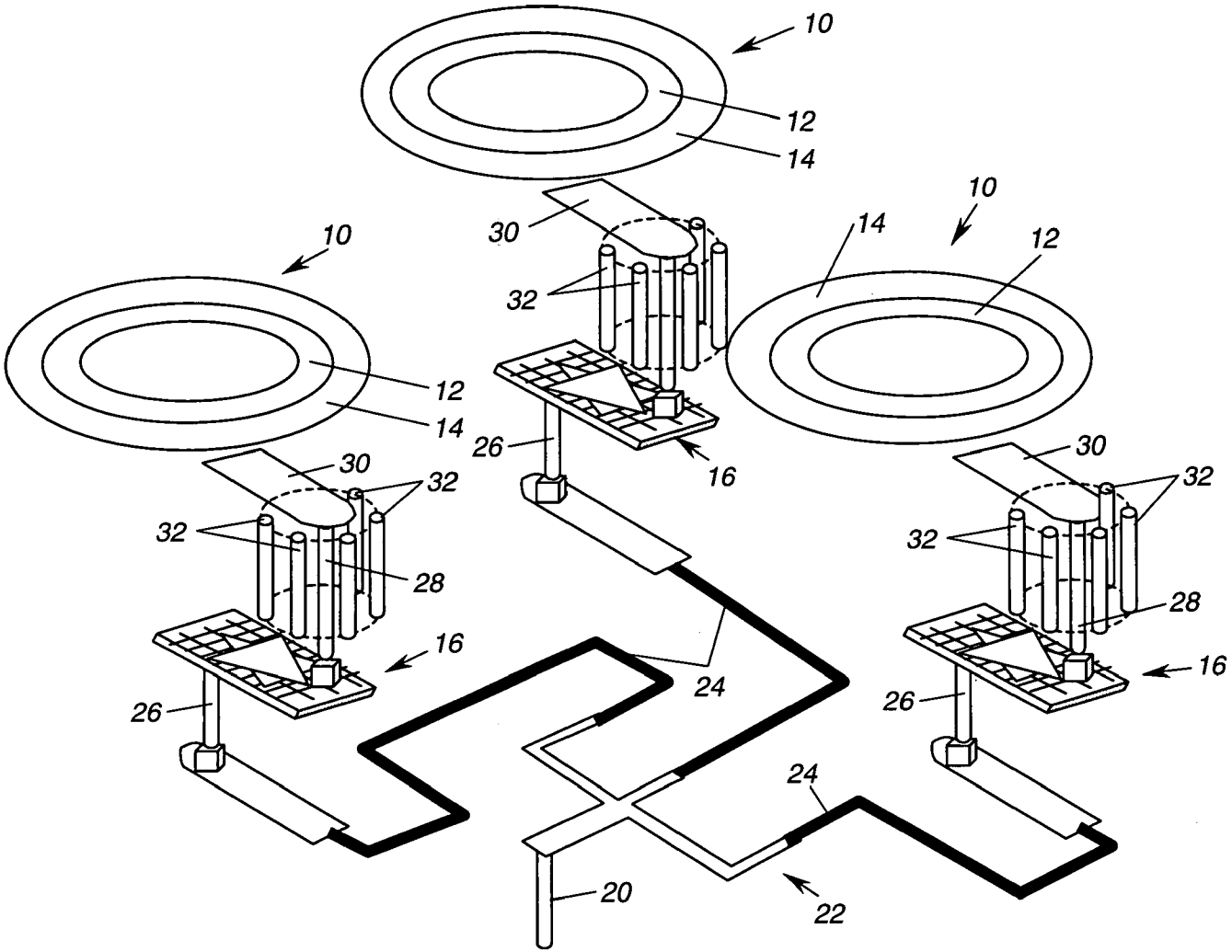
FIG. 1 is simplified isometric view showing a plurality of ring slot radiators and radio-frequency (RF) feed structures.

As shown in the drawings for purposes of illustration, the present invention pertains to a phased array antenna system having ring slot radiator elements, operable at millimeter-wave frequencies. Millimeter-wave frequencies are usually defined to be in the range 30–300 GHz. The present invention has important applications with a need for operation at frequencies in the vicinity of 35 GHz, and this description is consistent with a goal of operation at approximately this frequency. Prior to the present invention, arrays of ring slot radiators have been developed for operation at much lower frequencies but have not been capable of operation at millimeter-wave frequencies. One reason for this is that making a transition from a coaxial mode of transmission to a strip line mode for low profile coupling to a ring slot radiator is subject to an increasing impedance mismatch as the frequency is increased.

In accordance with one aspect of the present invention, operation at millimeter-wave frequencies is facilitated by a novel structure for effecting the transition from the coaxial mode to the strip line mode of transmission. In particular, the invention provides an antenna feed with a characteristic impedance equivalent to that of a 50-ohm coaxial circuit. The structural details relating to implementation of the transition to the strip line feed probe, while minimizing any impedance mismatch, will be best understood from the accompanying drawings and the following description.

FIG. 1 is an isometric view depicting three ring slot radiators, indicated by reference numeral 10, and their associated feed structures. Various dielectric layers and ground planes have been omitted from the figure for clarity. Each ring slot radiator 10 is formed as an annular slot 12 in a metal layer 14. The radiators 10 are integrated into a monolithic structure with many identical others, each with its own amplifier and control circuitry, shown in the figure as a millimeter wave integrated circuit (MMIC)16. A millimeter-wave radio-frequency (RF) signal for transmission is input to the structure over a common feed 20, is divided into multiple signals in a power divider 22, and then distributed to the individual radiator modules by transmission lines 24. It will be understood that, although the antenna functions are described in terms of a transmit function, the antenna operates equally well to receive millimeter-wave signals. For example, in the receive-mode the power divider 22 functions as a power combiner.

Each RF signal on a transmission line 24 is transmitted to the MMIC 16 through a via 26. After amplification and phase control in the MMIC 16, the RF signal is transmitted over a feed via 28 to a feed probe 30. The vias 26 and 28 are oriented generally perpendicular to the plane of the ring slot radiators 10 and the MMICs 16. The feed probe 30 is a strip line waveguide that is oriented in a plane parallel with and slightly below the ring slot radiator 10, and extends radially across the annular slot 12 of the radiator, to overlap the circular region of the metal layer 14 inside the slot.

Figure 2:
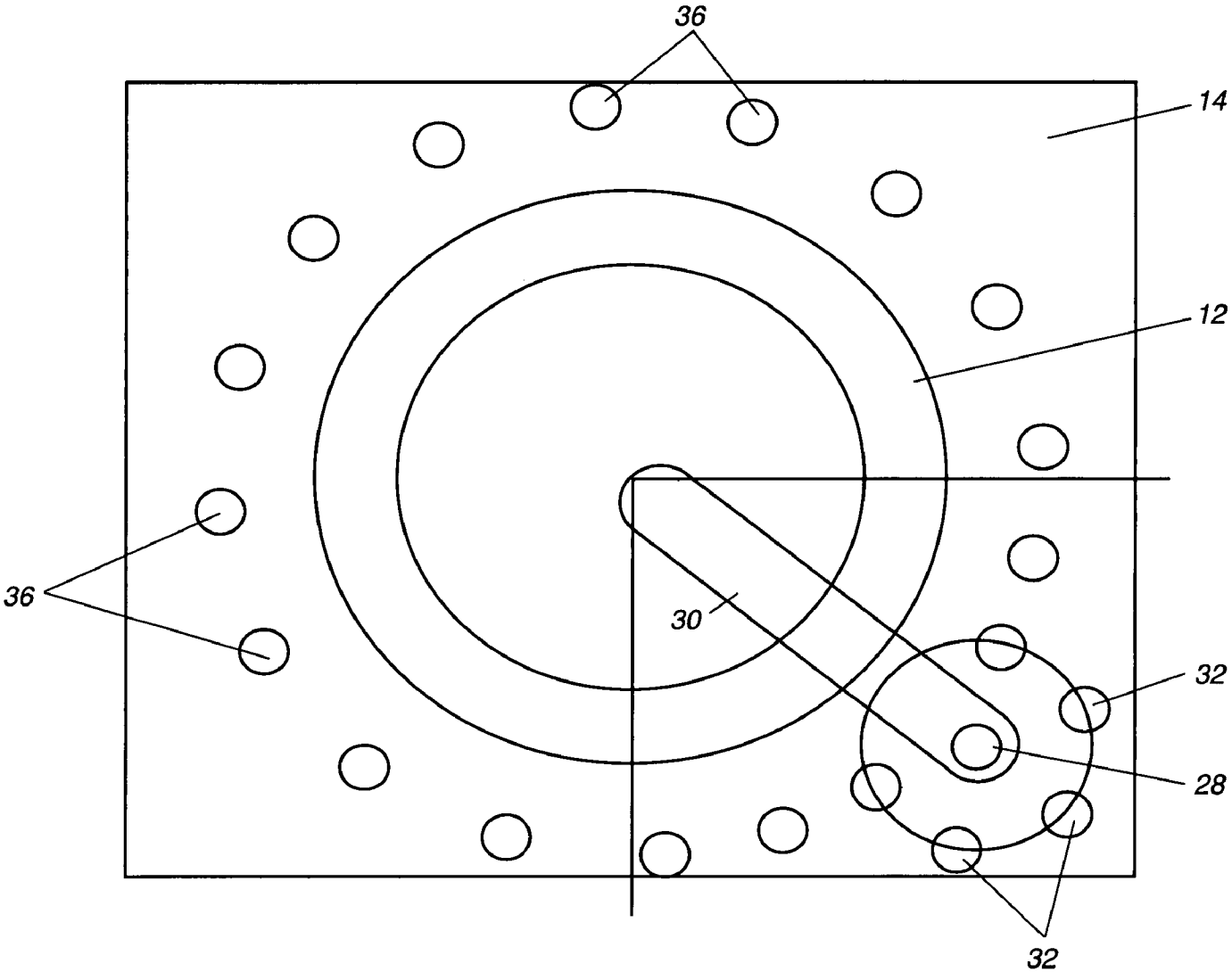
FIG. 2 is an enlarged plan view of a single ring slot radiator and its associated RF feed structure.

An important aspect of this feed structure is that the feed via is almost surrounded by five parallel mode suppressors 32. In the illustrative embodiment of the invention, the mode suppressors 32 are metal posts of the same diameter as the feed via 28. As best shown in FIG. 2, the mode suppressors 32 and the feed via 28 are, for example, 0.010 inch (0.25 mm) diameter and are centered on a circle of 0.046 inch (1.17 mm) diameter. The five mode suppressors 32 are angularly spaced at approximately 60° intervals, except that there is a larger angular space of approximately 120° in the region of the feed probe 30.

By way of further example, and as best shown in FIG. 2 in relation to a radiator element 10, the feed via 28 is located outside the radiator annular gap 12, at a radius of 0.091 inch (2.31 mm). In this example, the radiator slot 12 has an outer boundary diameter of 0.128 inch (3.25 mm) and an inner boundary diameter of 0.094 inch (2.39 mm). It will be understood that these dimensions are provided by way of example only and are not intended to be limiting. As also shown in FIG. 2, each ring slot radiator 10 also includes a plurality of mode suppressors 36 spaced uniformly around the annular slot 12. For example, the mode suppressors may be 0.010 inch (0.25 mm) diameter and positioned with their centers on a circle of 0.165 inch (4.19 mm) diameter. The number of mode suppressors 36 is not critical but in the example shown in FIG. 2 there are fifteen of them at an angular spacing of 20° to 22.5°, with a larger angular space in the region of the feed probe 30.

The mode suppressors 32 and 36 provide sufficient suppression for surface modes that would otherwise be transmitted between adjacent radiator elements 10. In addition, the five mode suppressors 32 carry an induced current that results in a negative reactance, which significantly neutralizes the self-reactance of the feed probe 28, allowing a smoother transition between the coaxial mode and the strip line mode of transmission. From a different perspective, the five plated-through vias forming the mode suppressors 32 and the centrally located feed probe 28 may be considered to form a coaxial-like transmission line that smoothes the transition or RF energy to the strip line mode.

Figure 3:
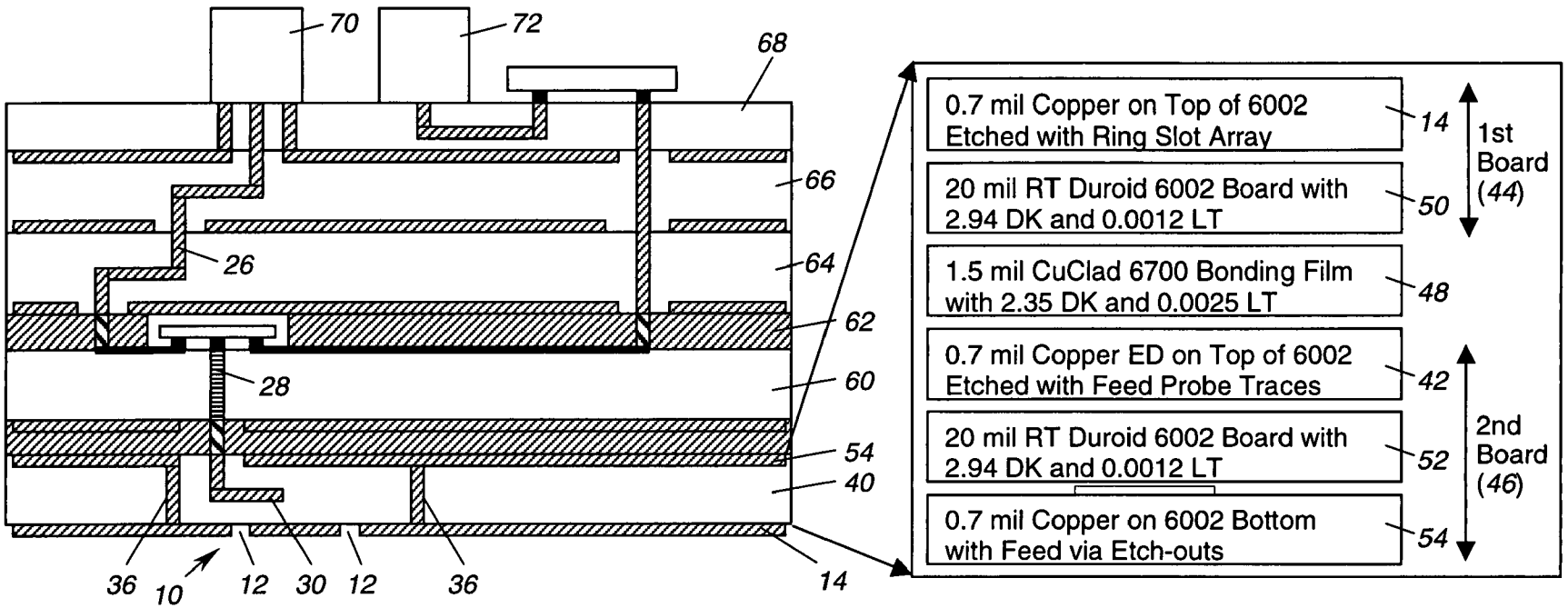
FIG. 3 is a fragmentary cross-sectional view of a ring slot radiator antenna structure in accordance with the invention.

FIG. 3 is a simplified cross-sectional view depicting multiple layers used to manufacture the antenna array of the invention in a structure that minimizes mechanical interconnections. The fabrication technique is often referred to as "connectionless." Where appropriate, components in this figures are identified by the same respective reference numerals used to identify components that were described above with reference to FIGS. 1 and 2.

The multiple layers of the structure include a radiator layer 40, which is further detailed in the table to the right of the figure. On the top face of the radiator layer 40 is the conductive (typically copper) layer 14 in which the ring slots 12 are etched. (The "top" face referred to in the previous sentence is shown at the bottom of FIG. 3.) The mode suppressors 36 are formed as plated through vias in the radiator layer 40. The other mode suppressors 32 surrounding the via 28 are omitted for clarity, but are impliedly present around all the RF vias. The feed probe 30 is formed within the radiator layer 40 by etching a copper layer 42 formed within the radiator layer. More specifically, the radiator layer 40 comprises a first board 44 and a second board 46 joined by a bonding film 48. The first board 44 includes a dielectric board 50 on which the copper layer 14 is formed. The second board 46 is another dielectric board 52, on the top of which the copper layer 42 is formed and etched to define the feed probe(s) 30, and on the bottom of which is formed another copper layer 54, which is etched to provide openings for the probe via(s) 28.

The radiator layer 40 is bonded to a silicon motherboard 60, on the reverse side of which are located a MMIC layer 62, RF processing layers 64 and 66 and, lastly, a digital control board 68. An RF input/output connector 70 on the bottom of the digital control board 68 couples RF signals to (or from) the MMIC layer 62, and the RF processing layers 64 and 66 perform the signal dividing or combining function. Control signals are applied through an input connector 72, and eventually coupled through a via 74 to the MMIC layer 54. The control signals are translated into phase control signals applied to the radiator 10, and collectively comprise a beam forming network that controls the angular direction of the beam transmitted from or received by antenna array.

Figure 4:
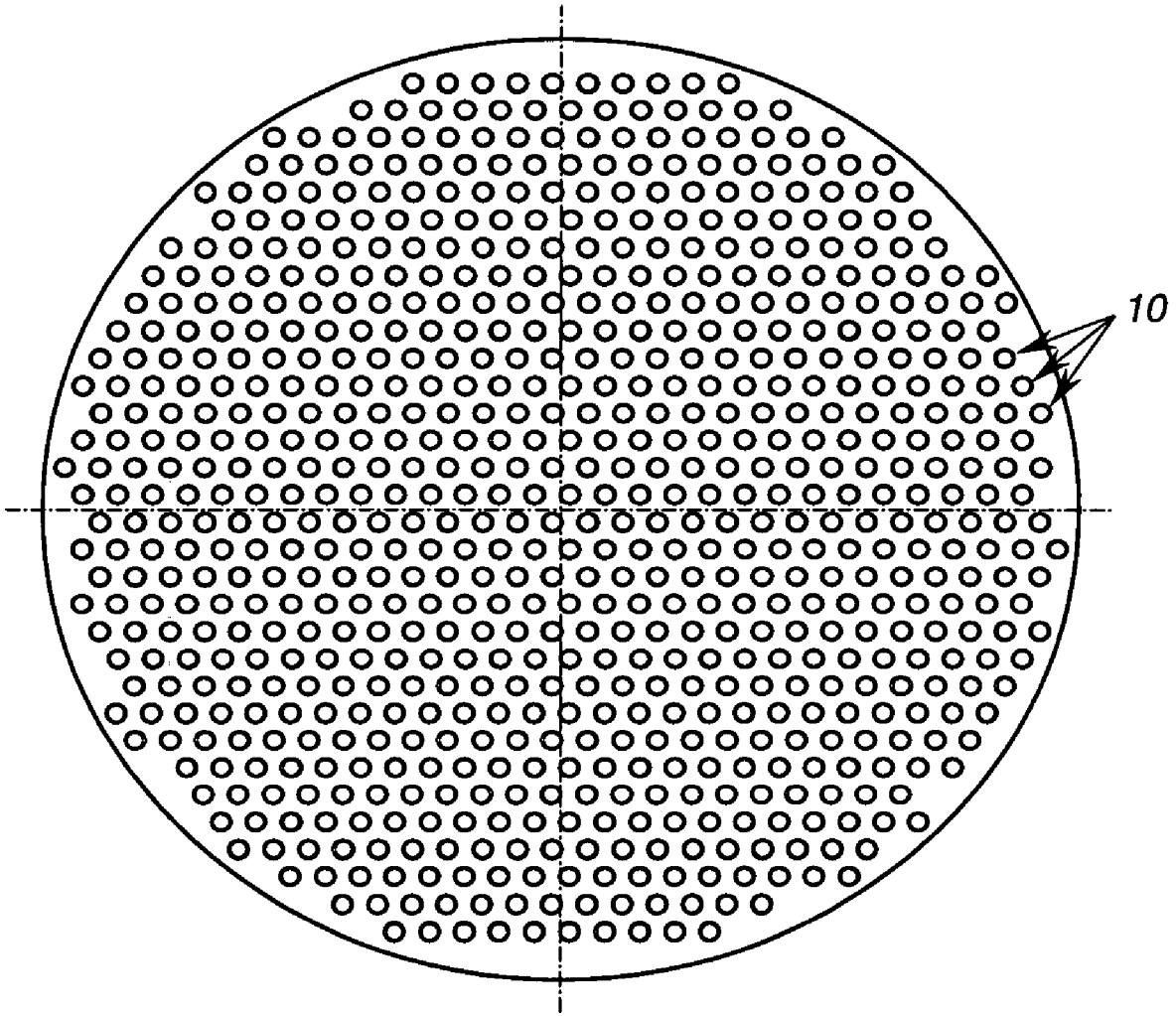
FIG. 4 is a simplified plan view of an antenna array in accordance with the invention.
Figure 5:
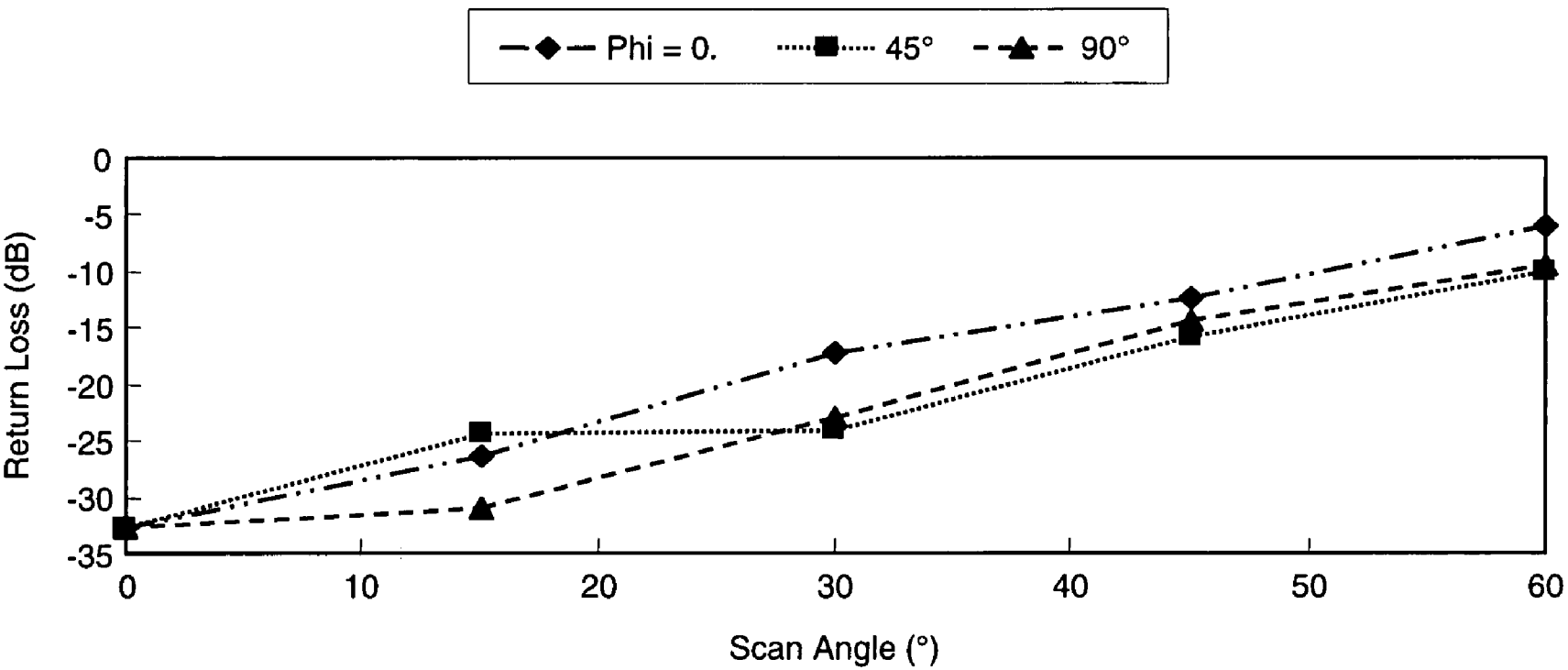
FIG. 5 is a set of graphs showing the variation of return loss with scan angle in one axis and pointing angle in an orthogonal axis.

FIG. 4 shows an example of a 738-element antenna array. Each of the small circles is a ring slot radiator 10 having the structure described above with reference to FIGS. 1–3. Because the array is not perfectly symmetrical in all directions, it exhibits slightly different characteristics depending on the azimuth angle of the desired beam direction. For example, the return loss characteristics of the antenna array vary slightly with the azimuth angle (ø) and also vary with the scan angle, which is the angle of beam deflection from the normal direction to the array. The return loss, usually expressed in decibels (dB), is the ratio of the power reflected back into the antenna to the total power fed to the antenna. FIG. 5 shows the predicted radiator return loss for scan angles of 0° to 60° and for beam deflection in azimuth directs of 0° 45° and 90°.

Figure 6:
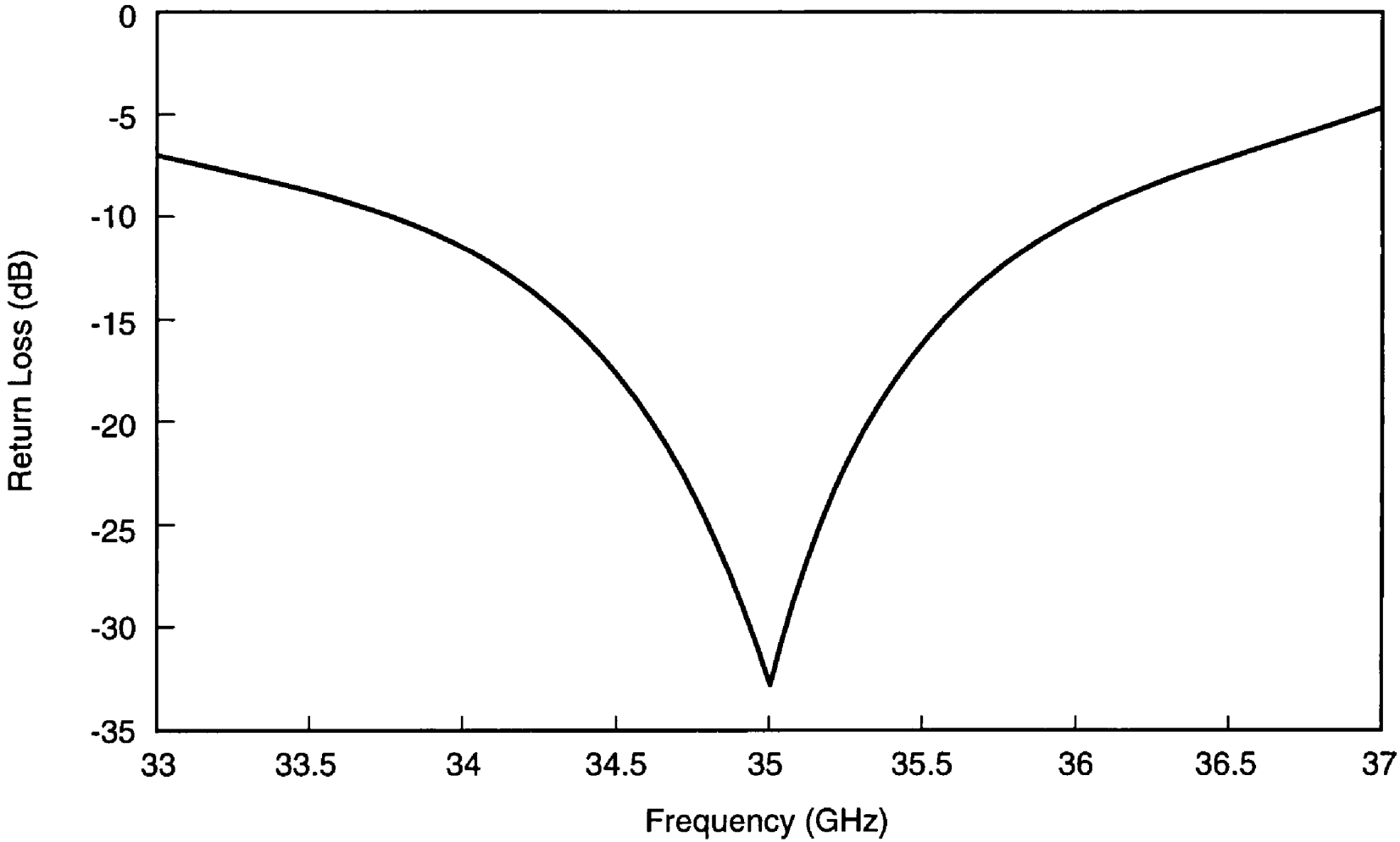
FIG. 6 is a graph showing the variation of predicted return loss with frequency for the embodiment of the invention depicted in FIG. 3.
Figure 7:
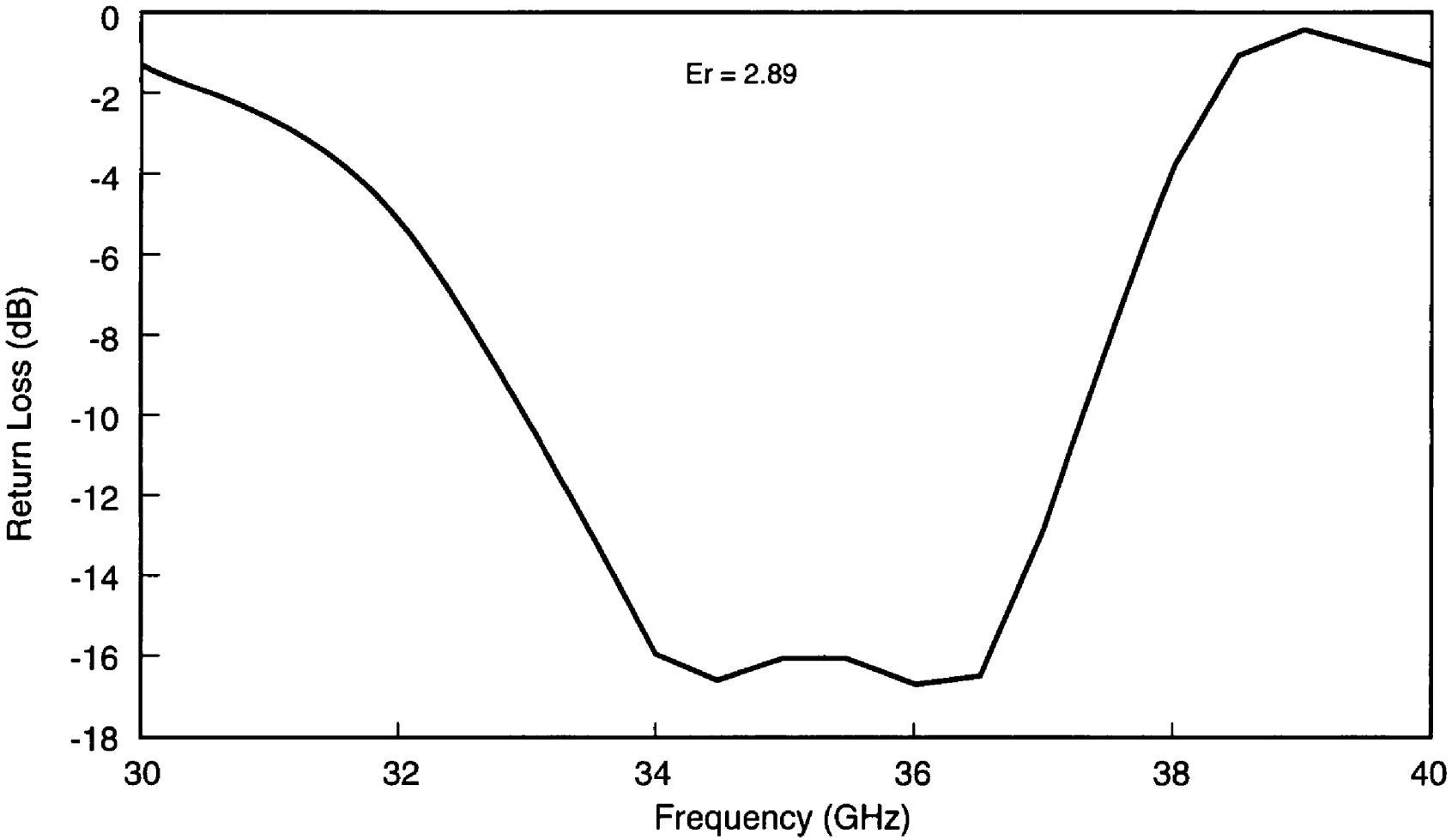
FIG. 7 is a graph similar to FIG. 6, but pertaining to an alternate embodiment of the invention.
Figure 8:
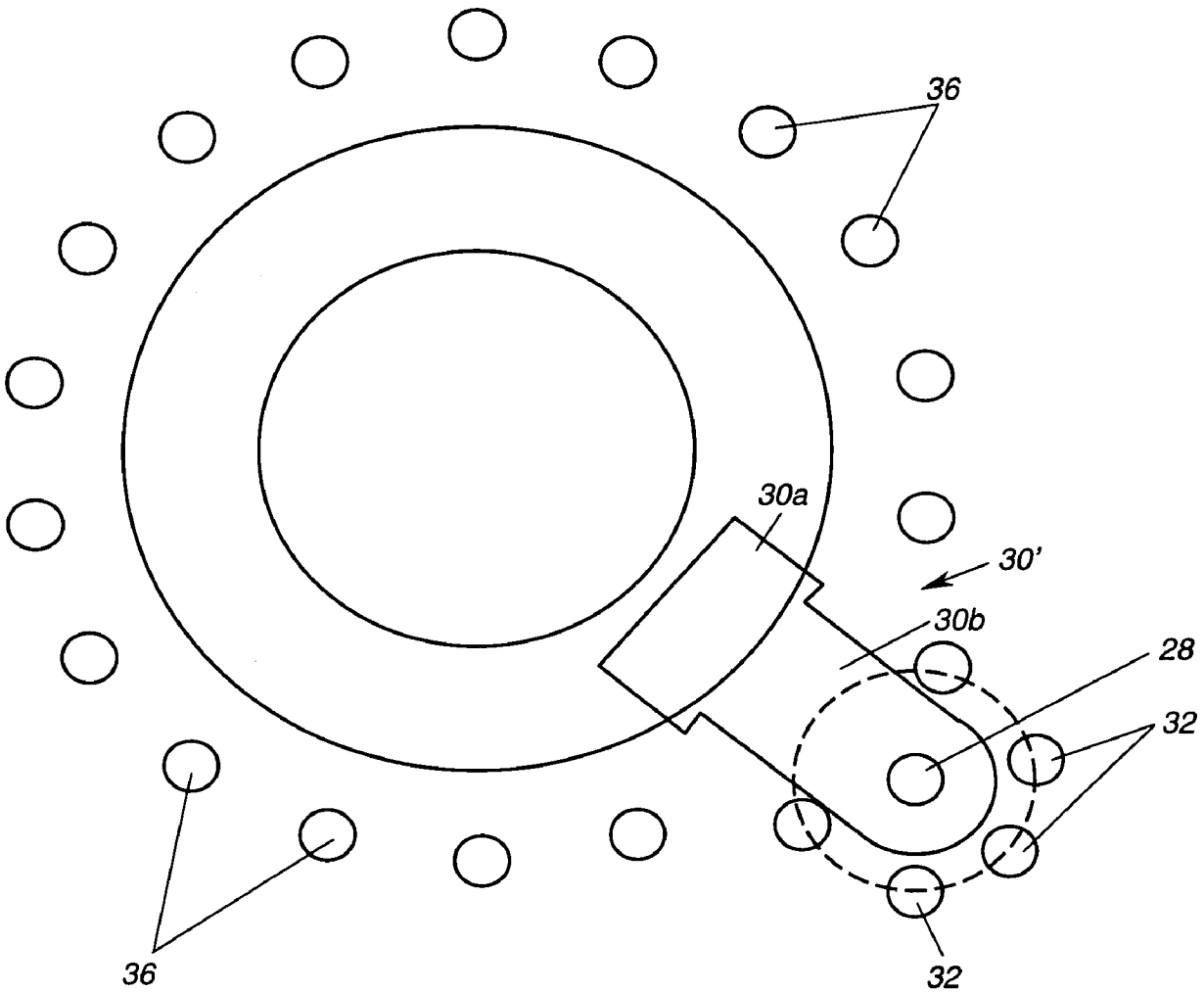
FIG. 8 is a plan view of a single ring slot radiator similar to FIG. 3, but depicting an alternate embodiment providing a wider bandwidth as illustrated in FIG. 7.

FIG. 6 is a graph showing the variation, with frequency, of the predicted return loss of the an antenna ring slot element in accordance with the invention. FIG. 7 is a similar graph, but for an alternate embodiment of the invention providing a wider bandwidth or approximately 10% of the resonant frequency of the element (approximately 3 GHz). It is known that most of the RF coupling between the strip line feed probe 30 and the radiator slot 12 takes place through the open-end region of the probe, where the strip line becomes discontinuous. A 50-ohm strip line makes a very narrow coupling aperture (approximately equal to the width of the strip plus fringing effects), which results in a very narrow-band radiator. (For strip or microstrip radiators, bandwidth is typically proportional to the aperture size.) To improve the bandwidth, a larger aperture size strip line is used for the probe 30. This necessitated a taper transition to match the low-impedance strip line with the 50-ohm coaxial probe feed. FIG. 8 is a fragmentary plan view of the wideband version of the ring slot radiator 10. The modified feed probe 30' is widened at the end region 30*a*, where coupling with the slot occurs, and extends over the slot 12 but beyond it. The modified feed probe 30' also has a tapered section 30*b*, between the widened end region 30*a* and the transition to the feed via 28.

It will be appreciated from the foregoing that the present invention represents a significant advance in the field of miniature phased array antenna systems. In particular, the invention provides a compact phased array antenna that produces a beam at millimeter-wave frequencies, steerable over at least 60° in each direction, with no unwanted grating lobe and a good directivity pattern. The manufacturing process employed to fabricate the antenna array uses standard printing circuit fabrication and lamination techniques, and produces the product at relatively low cost and at high yield. The process is fully automatic and, therefore, not labor intensive. It will also be appreciated that, although embodiments of the invention have been described in detail, various modifications may be made without departing from the spirit and scope of the invention. Accordingly, the invention should not be limited except as by the appended claims.

The invention claimed is:

1. A ring slot radiator structure for use in a phased array antenna system, the ring slot radiator structure comprising:

a dielectric substrate, having a top face and a bottom face;

a conductive layer formed over the top face of the substrate and having an annular gap that in part defines a radiator element;

a conductive feed via extending part-way through the substrate in a direction normal to the conductive layer, to transmit radio-frequency (RF) energy from a location located at the bottom of the substrate to transition point located outside the annular gap in the conductive layer and spaced beneath the conductive layer;

a strip line feed probe extending from the transition point in a generally radial direction parallel to the conductive layer and at least partially across the annual gap; and a plurality of mode suppressor posts extending through the substrate in a direction parallel to the conductive feed via and spaced in a generally uniform array around the conductive feed via;

wherein the plurality of mode suppressor posts effect a smooth transition from a coaxial mode of transmission through the conductive feed via to a strip line mode of transmission along the strip line feed probe that couples RF energy to the ring slot radiator.

2. A ring slot radiator structure as defined in claim 1, and further comprising another plurality of mode suppressors, also extending in a direction normal to the conductive surface, and spaced about and outside the annular gap to effect better isolation of the ring slot radiator element from other neighboring elements.

3. A ring slot radiator structure as defined in claim 1, wherein:

the strip line feed probe is generally uniform in width and extends fully across the annular gap toward the geometric center of the annular gap; and the ring slot radiator structure has a relatively narrow bandwidth in the order of 1%.

4. A ring slot radiator structure as defined in claim 1, wherein:

the strip line feed probe comprises a first section of uniform width extending from the transition point to a point near the outer diameter of the annular gap, and a contiguous transition section of increased width extending part-way across the annular gap; and the ring slot radiator structure has an increased bandwidth in the order of 10%.

5. A miniature phased array antenna system capable of operation at millimeter-wave frequencies and formed as a unitary structure, comprising:

a multilayer structure having an upper face from which radiation is transmitted in a transmit mode of operation and which receives radiation in a receive mode of operation, and a lower face to accommodate radio-frequency (RF) feed and control circuitry;

a conductive layer formed over the top face of the substrate and having a plurality of annular gaps formed in a geometric array, wherein each annular gap in part defines one of a plurality of ring slot radiator elements;

an equal plurality of conductive feed vias extending part-way through the multi-layer structure in a direction normal to the conductive layer, each capable of transmitting radio-frequency (RF) energy from a location located at the bottom of the substrate to transition point located outside one of the annular gaps in the conductive layer and spaced beneath the conductive layer;

an equal plurality of strip line feed probes, each extending from the transition point associate with one of the plurality of radiator elements in a generally radial direction with respect to its annular gap, parallel to the conductive layer and at least partially across the annual gap;

an RF divider/combiner, integrated into the multi-layer structure and coupled to each of the conductive feed vias and to an RF transmitter/receiver connector; and an equal plurality of sets of mode suppressor posts, each set being associated with a corresponding one of the conductive feed vias, and extending through the multi-layer structure in a direction parallel to the conductive feed via and spaced in a generally uniform array around the conductive feed via;

wherein each set of mode suppressor posts effects a smooth transition from a coaxial mode of transmission through the conductive feed via to a strip line mode of transmission along the strip line feed probe that couples RF energy to the ring slot radiator.

6. A miniature phased array antenna system as defined in claim 5, and further comprising an additional equal plurality of sets of mode suppressors, also extending in a direction normal to the conductive surface, the mode suppressors in each set being spaced about and outside the annular gap of a corresponding ring gap radiator element, to effect better isolation of each ring slot radiator element from the other neighboring elements.

7. A miniature phased array antenna system as defined in claim 5, wherein:

each of the strip line feed probes is of generally uniform width and extends fully across the annular gap toward the geometric center of the annular gap; and the antenna system has a relatively narrow bandwidth in the order of 1%.

8. A miniature phased array antenna system as defined in claim 5, wherein:

each of the strip line feed probes comprises a first section of uniform width extending from the transition point to a point near the outer diameter of the annular gap, and a contiguous transition section of increased width extending part-way across the annular gap; and the antenna system has an increased bandwidth in the order of 10%.

* * * * *